United States Patent [19]

Van Dijk

[11] Patent Number: 5,067,312

[45] Date of Patent: Nov. 26, 1991

[54] PROCESS AND DEVICE FOR PACKING OBJECTS IN STRETCH FILM

[75] Inventor: Dick Van Dijk, Ermelo, Netherlands

[73] Assignee: Apollo B.V., Nijkerk, Netherlands

[21] Appl. No.: 619,410

[22] Filed: Nov. 29, 1990

[30] Foreign Application Priority Data

Dec. 5, 1989 [NL] Netherlands ..... 8902994

[51] Int. Cl.[5] ..... B65B 11/08

[52] U.S. Cl. ..... 53/556; 53/586; 53/228

[58] Field of Search ..... 53/228, 229, 553, 556, 53/586

[56] References Cited

U.S. PATENT DOCUMENTS

| | | | |
|---|---|---|---|
| 3,306,003 | 2/1967 | Sundy | 53/586 X |
| 3,841,057 | 10/1974 | Engeler | 53/228 |
| 3,990,215 | 11/1976 | Elsner | 53/586 X |
| 4,628,668 | 12/1986 | Wildmoser | 53/586 X |

*Primary Examiner*—John Sipos

*Attorney, Agent, or Firm*—Young & Thompson

[57] ABSTRACT

In a device for packaging objects in stretch film, the film (3) intersects the supporting face determined by the conveyor track (1), and the conveyor track (1) is at least partially of a width which is smaller than that of the objects (2) to be packed, in such a way that the latter project at the longitudinal sides relative to the conveyor track (1) and the part of the film situated below the supporting face can wrap around the bottom longitudinal edges against and on the edge areas of the bottom side of the objects to be packed. A transverse part (9) of the conveyor track (1) which in the direction of conveyance of the objects (2) connects directly to the place where the film (3) intersects the conveyor track (1) is open or has a transverse section (14) which can be moved away out of the conveyor track (1), in such a way that, after the weld (8) is cut, a space is formed in which the film (3) projecting downwards relative to the rear side of the objects (2) can wrap around the rear, bottom transverse edge of the objects (2) against and on the edge area.

6 Claims, 3 Drawing Sheets

PROCESS AND DEVICE FOR PACKING OBJECTS IN STRETCH FILM

The present invention relates to a process for packing objects in stretch film, in which process said objects and the film can be moved towards each other transverse relative to a plane in which said film is stretched, in such a way that the film encloses the front side and the longitudinal sides of the objects, following which the film is fitted against the longitudinal sides, and from each longitudinal side is fitted on the rear side in such a way that said rear side is covered by two pieces of film running towards each other, after which said pieces of film are welded together and the weld is cut through the centre, and a film composed of two pieces of film welded together and stretched in the above-mentioned plane is formed for packing the following objects. Such a process is known from U.S. Pat. No. 4,413,463.

In the case of this known process the object is packed all the way round on the side faces in a stretch film which is pressed with a certain pre-tension on the object. The disadvantage of this process is that the film cannot be fitted on the top and bottom side of the objects. This means that this process is not very suitable for packing a stack of relatively flat objects, for example newspapers. The top and bottom flat objects cannot be retained if the film does not extend over the entire height of the stack.

The object of the invention is therefore to provide a process of the above-mentioned type which does not have this disadvantage. This is achieved through the fact that in the above-mentioned plane the film extends until it is below—or below and above—the objects, in such a way that when the film is being fitted on the front side, the longitudinal sides and the rear side of the objects, the film parts in each case extending below—or below and above—said objects, as a result of the tensile stresses in the film, come to lie on the edge areas of the bottom side—or of the top side and the bottom side—of said objects adjoining said sides. As a result of the internal pre-tensioning force during fitting, the part of the film projecting relative to the objects will "curl round" and thus still come to lie on the objects. In the process it bends round the edges of the objects. This behaviour occurs through the forces in the film. After cutting through and releasing of the weld, the film will try to contract as much as possible. Thanks to the film edge strips thus formed on the top or bottom face of the processed stack, the latter is held firmly together.

The invention also relates to a device for carrying out said process, provided with a conveyor track for conveyance of the objects to be packed, feed and tensioning means for the film, disposed on either side of said track, and means for fitting the film on the rear side of the objects from the longitudinal sides of the objects, welding the film parts together there, and cutting the weld through the centre. Such a device is also known from U.S. Pat. No. 4,413,463; but it is not suitable for carrying out the process according to the invention. The object of the invention is therefore to provide such a device with which this is actually possible. This is achieved in that the film intersects the supporting face determined by the conveyor track, in that the conveyor track at least partially is of a width which is smaller than that of the objects to be packed, in such a way that the latter project at the longitudinal sides relative to said conveyor track and that the part of the film situated below said supporting face can wrap around the bottom longitudinal edges against and on the edges areas of the bottom side of the objects to be packed, and in that a transverse part of the conveyor track which in the direction of conveyance of the objects connects directly to the place where the film intersects said conveyor track is open or has a transverse section which can be moved away out of the conveyor track, in such a way that a space is formed in which, after the weld is cut, the film projecting downwards relative to the rear side of the objects can wrap around the rear, bottom transverse edge of the objects against and on said edge area.

Past the plane in which the film is stretched, the objects project at both sides relative to the conveyor track. Normally speaking, this need not be a problem when the object is moving along the conveyor track. If desired, full support of the objects during transportation can still be ensured through the fact that on either side of the track, in the direction of conveyance past the transverse section of the conveyor track which can be moved away, provision is made for longitudinal sections which are situated on the sides of the conveyor track and can be moved relative to the track to below the level of said track and back. These longitudinal sections, like the transverse section, are moved downwards temporarily only when the film is being fitted around the objects. Once the film is fitted, they can be moved up again, in such a way that the objects are fully supported again.

According to a preferred embodiment, provision is made in this case for the longitudinal sections which are movable up and down to be accommodated in a first frame which is pivotable about a pivot line running crosswise downstream of the tensioning means. Such an embodiment offers a simple, yet sturdy construction, while the movements of the track parts which can be moved up and down can now always run in synchronism. Provision can also be made for the transverse section which moves up and down to be accommodated on a second frame which is pivotable about the same pivot line as the first frame.

When the film is being fitted on the rear side of the objects, the pushing element by means on which they are pushed against the force exerted by the film must be removed. In order to prevent the objects from being moved back by the film at that moment, provision is made for a clamping element by which the objects can be fixed on the track in order to eliminate the reaction forces produced by the film being carried along.

The invention will be explained in greater detail below with reference to an example of an embodiment.

Figure 1:
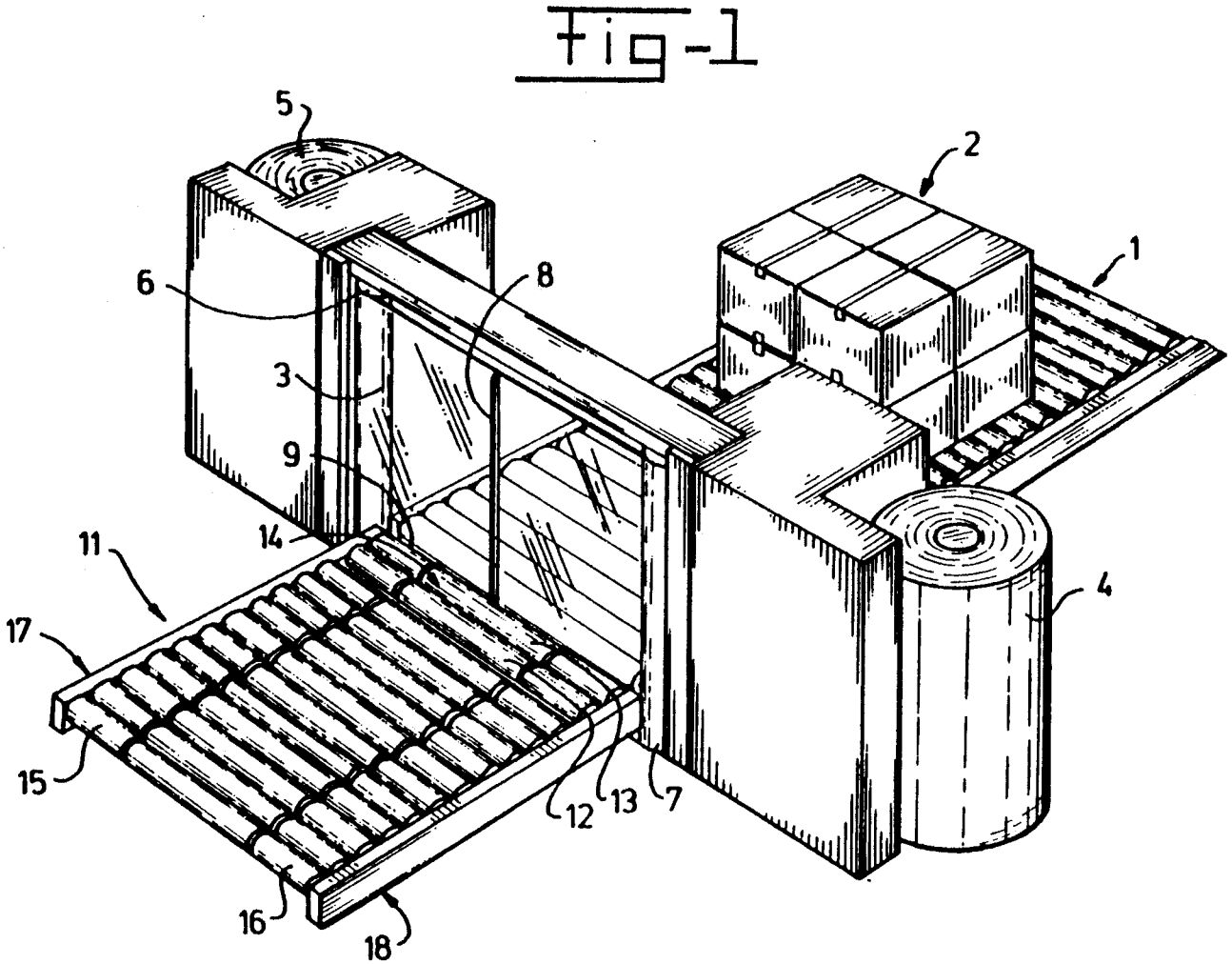
FIG. 1 shows a view in perspective of the device according to the invention.

The device according to the invention shown in FIG. 1 is provided in a known manner with a conveyor track or conveyor plate 1, along which the objects 2 to be packed, for example a number of boxes, can be fed in to a film 3 running transverse relative to the conveyor track 1. The film comes from two stock rolls 4, 5, and is held under pre-tension by means of known tensioning means (not shown). The film is positioned by means of the rollers 6, 7. The film parts coming from the rolls 4, 5 are welded together in the centre relative to the conveyor track 1 by means of weld 8, which will be reversed to later. Tensioning means (not shown) are also provided with these devices for holding the film 3 under pre-tension, which means are already known per se and will not be explained any further here.

Figure 3:
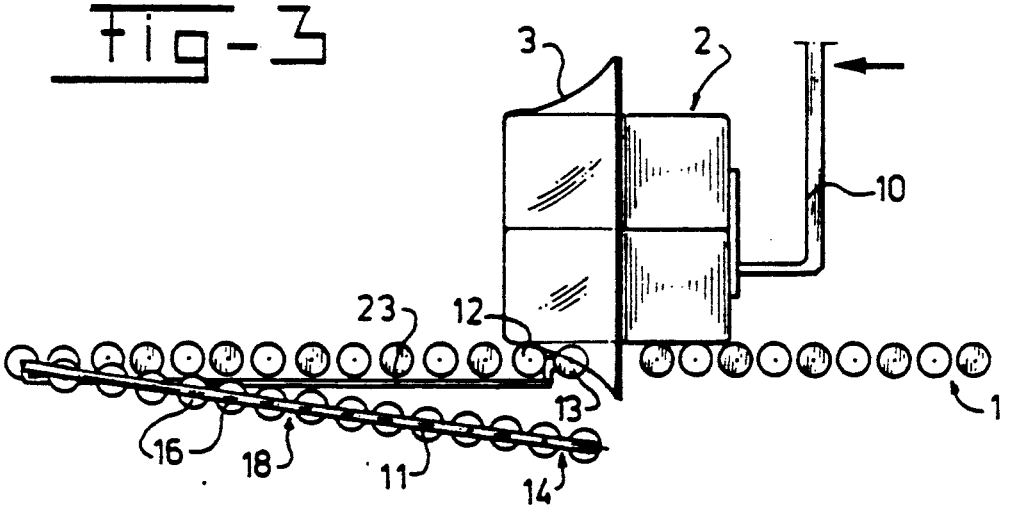
FIG. 3 shows, corresponding to FIG. 2, the second step of carrying out the process according to the invention.
Figure 4:
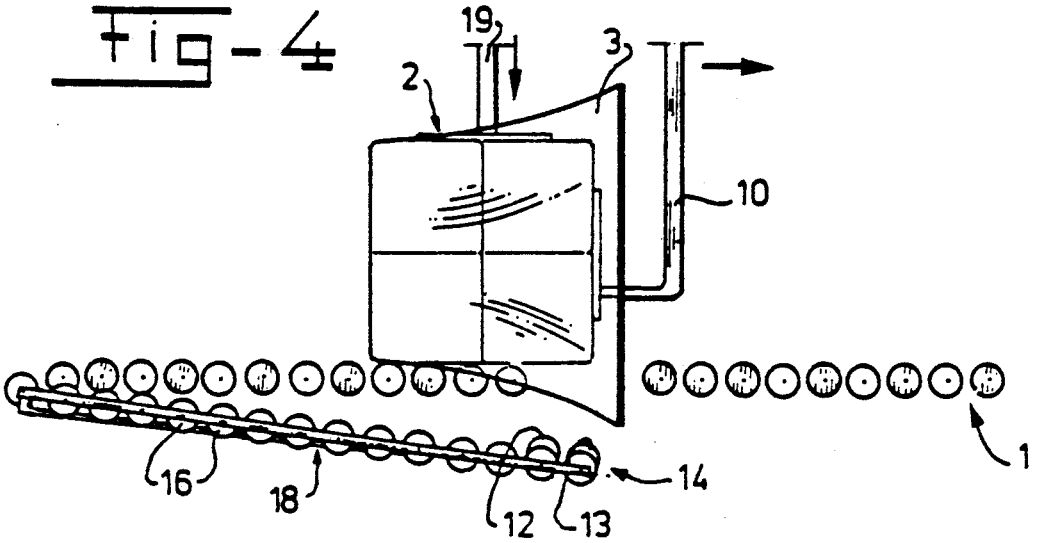
FIG. 4 shows, corresponding to FIG. 2, the third step of carrying out the process according to the invention.

As can be seen from FIG. 1, the conveyor track 1 is interrupted at the level of the film 3, in such a way that the film 3 runs through the transverse gap 9 in the conveyor track 1. All this is also shown in FIGS. 2 to 4.

Figure 2:
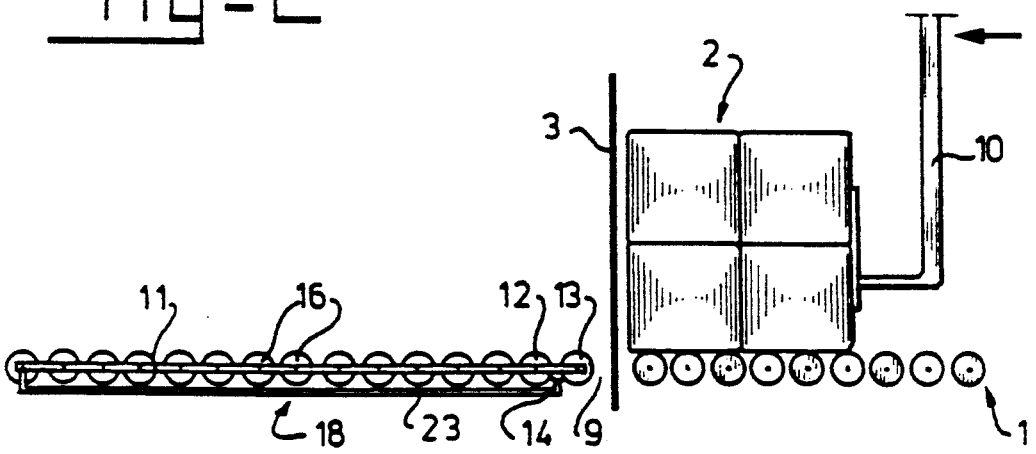
FIG. 2 shows schematically in side view the first step of carrying out the process according to the invention.

FIG. 2 shows the stack of objects 2 in a position in which it lies just before the film 3. The stack of objects 2 is in this case pushed by a pushing element 10 in the direction of the arrow. As shown in FIG. 3, the stack of objects 2 is subsequently pushed further against the film 3, in such a way that the film 3 is carried along by the stack of objects 2. In the process the film comes to rest partially below the front bottom edge of the bottom side of the stack of objects 2. The frame 11 with, as shown in FIG. 1, the rollers 15, 16 which together from the longitudinal sections 17, 18, moves downwards here. This produces space at the side below the stack of objects, so that first of all, under the influence of the pre-tension under which it is held, the film can flap over onto the side edge parts of the bottom side of the stack of objects 2. Said stack is thereby gradually pushed further and further forward by the pushing element 10 until the stack is situated in a position past the plane in which the film 3 was originally situated (see FIG. 4). When it arrives there, the pushing element 10 is moved away backwards, after the clamping element 19 is fitted on the stack of objects 2 and holds them fast against the resilience of the film 3. After that, the frame 23 with the rollers 12, 13, together forming the transverse section 14, can be moved downwards (see FIG. 4).

Figure 5:
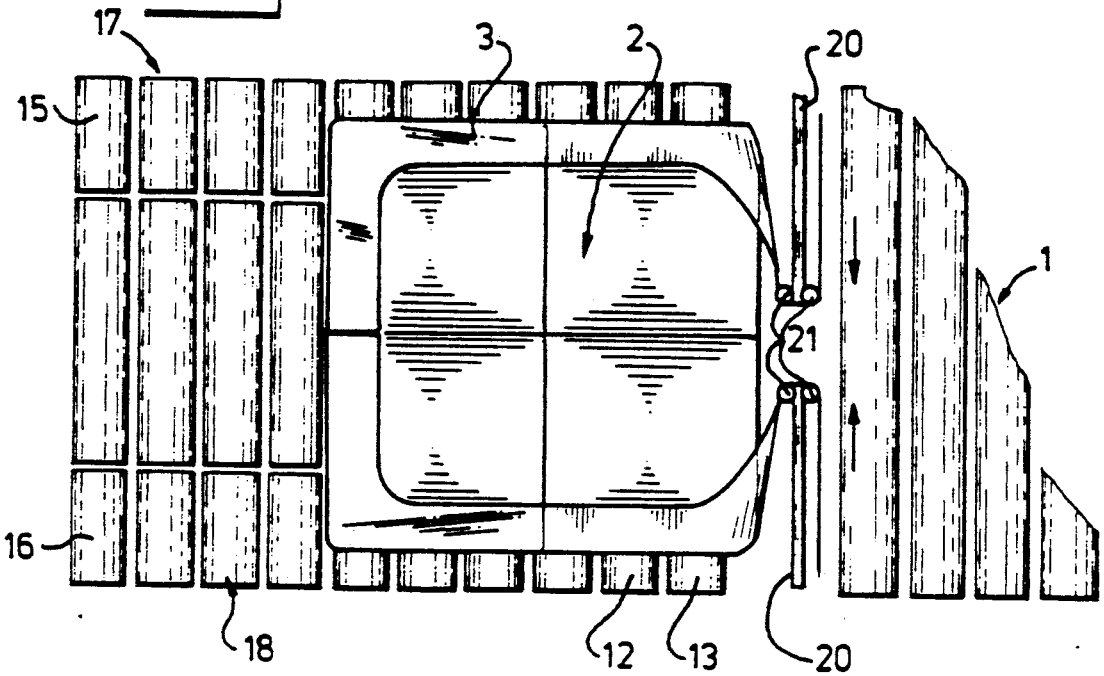
FIG. 5 shows the fourth step of carrying out the process according to the invention.
Figure 6:
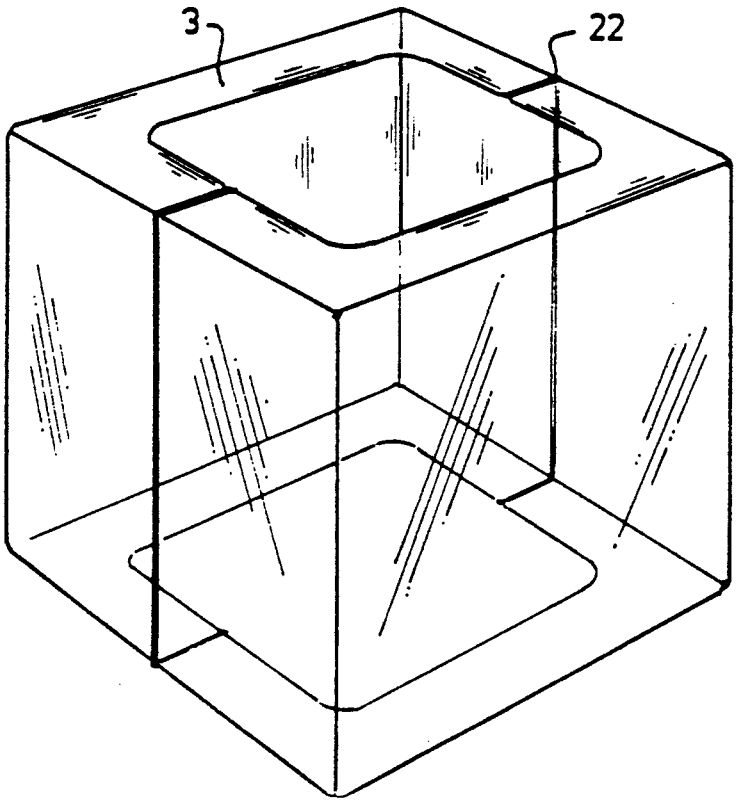
FIG. 6 shows in perspective a ready wrapper, produced by the process according to the invention.

Thereafter, as shown in FIG. 5, the film 3 is fitted in the known manner on the rear side of the stack of objects 2. For this purpose, as shown, provision is made for pushing elements 20 which at their end have deflection rollers 21 for the film, and also a welding and cutting device (not shown). As soon as the film parts at the rear side of the stack of objects 2 are welded together, the weld is cut through, so that the pack form shown in FIG. 6 is obtained. The film situated at the rear side of the stack of objects also wraps around the edge area of the top face of the stack of objects 2 here, after the weld 22 is cut through. Since the transverse section 14, comprising the transverse rollers 12, 13, is moved away from the conveyor track, the film can also flap over at the bottom side on the edge area of the bottom side of the stack of objects 2.

When the stack of objects is thus wrapped, the frames 11 and 23 are moved upwards again, so that a complete conveyor track is formed, along which the stack of objects 2 can then be discharged after clamping element 19 is moved upwards.

I claim:

1. In a device for packaging objects in stretch film, provided with a horizontal conveyor track for conveyance of the objects to be packed, feed and tensioning means for the film disposed on either longitudinal side of said track for feeding the film in a vertical plane across the track so that as said object is moved into the film the front side and the two longitudinal sides are wrapped by the film, and means for fitting, welding and cutting the film on the rear side of the objects; the improvement in which the film intersects the supporting face of the conveyor track and extends below said track, the conveyor track at least partially is of a width which is smaller than that of the objects to be packed, in such a way that the latter project at the longitudinal sides relative to said conveyor track and that the part of the film situated below said supporting face can wrap around the bottom longitudinal edges against and on the edge areas of the bottom side of the objects to be packed, a transverse part of the conveyor track having transverse section downstream of said plane which in the direction of conveyance of the objects connects directly to the plane where the film intersects said conveyor track and is movably mounted relative to said track, and means for moving said transverse section out of the conveyor track after the weld is cut, so that a space is formed in said track adjacent said plane in which space the film projecting below said track wraps around the rear, bottom transvese edge of the objects against and on said edge area.

2. Device according to claim 1, wherein on either side of the track, in the direction of conveyance past the transverse section of the conveyor track which can be moved away, provision is made for longitudinal sections which are situated on the sides of the conveyor track and can be moved relative to the track to below the level of said track and back.

3. Device according to claim 1, the transverse section can be moved up and down.

4. Device according to claim 3, wherein the longitudinal sections which are movable up and down are accommodated in a first frame which is pivotable about a pivot line running crosswise downstream of the tensioning means.

5. Device according to claim 3, wherein the transverse section which is movable up and down is accommodated on a second frame which is pivotable about the same pivot line as the first frame.

6. Device according to claim 1, wherein provision is made for a clamping element by which the objects can be fixed on the track in order to eliminate the reaction forces produced by the film being carried along.

* * * * *